US007322272B2

(12) United States Patent
Müller

(10) Patent No.: US 7,322,272 B2
(45) Date of Patent: Jan. 29, 2008

(54) PISTON AND A POWER CYLINDER FITTED THEREWITH

(75) Inventor: Gerald Müller, Stuttgart (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 11/294,021

(22) Filed: Dec. 5, 2005

(65) Prior Publication Data

US 2006/0162551 A1 Jul. 27, 2006

(30) Foreign Application Priority Data

Jan. 25, 2005 (DE) ..... 20 2005 001 117 U

(51) Int. Cl.
*F01B 11/02* (2006.01)
*F15B 15/22* (2006.01)

(52) U.S. Cl. ..... 92/85 R; 92/249; 277/436

(58) Field of Classification Search ..... 277/436, 277/465; 92/85 R, 249
See application file for complete search history.

(56) References Cited

U.S. PATENT DOCUMENTS 1,478,561 A * 12/1923 Faessel ..... 277/436
2,902,828 A * 9/1959 Felt ..... 92/249
3,176,595 A * 4/1965 Schwartz ..... 92/249
3,913,460 A * 10/1975 Wright ..... 92/85 R

FOREIGN PATENT DOCUMENTS

DE 24 07 989 C2 8/1982
DE 199 25 083 A1 12/2000
DE 201 01 49 U1 5/2001

* cited by examiner

*Primary Examiner*—F. Daniel Lopez
(74) *Attorney, Agent, or Firm*—Hoffmann & Baron, LLP

(57) ABSTRACT

A piston for a fluid operated power cylinder has two mutually coaxial sealing lips axially extending away from each other and being able to radially yield, for sealing engagement with the piston running face of the power cylinder and adjacent to at least one piston end side an elastic buffer body serving for shock absorbing in the end of stroke position of the piston, said body having an impact face facing away from the piston. At least at one piston end face the sealing lip itself constitutes the buffer body and has the impact face at its end, groove-like recesses being formed on the inner periphery of the sealing lip with a distribution in the peripheral direction, such recesses opening toward said impact face.

23 Claims, 3 Drawing Sheets

PISTON AND A POWER CYLINDER FITTED THEREWITH

BACKGROUND OF THE INVENTION

The invention relates to a piston for a power cylinder able to be operated by fluid force, comprising two coaxial and radially yielding sealing lips extending axially away from each other and adapted for sealing engagement with the piston engaging face of the power cylinder, and an elastic buffer body arranged in the vicinity of at least one terminal piston face and adapted to serve for impact damping in the end of stroke position of the piston, said buffer body having an impact face turned away from the piston.

Furthermore the invention relates to a power cylinder fitted with such a piston and having a cylinder housing defining a piston receiving space for the piston, said space having a peripheral piston running face and terminal abutment faces.

THE PRIOR ART

Such a piston with an associated cylinder is disclosed in the German patent publication 19,925,083 A1. Here the piston is fitted at both its terminal faces with a respective segmented buffer body, which may in the end of stroke position abut against the facing abutment face of the housing in order to damp the impact of the piston.

For sealing the piston on the piston running face an annular and radially yielding sealing lip is provided radially clear of a respective buffer body.

A comparable arrangement is also described in the German utility model 20,101,049.

Pistons and power cylinders of the above described type operate reliably. In the case of small overall sizes with a small diameter however the accommodation of effective buffer bodies is obstructed, because the space available for them is reduced, more particularly owing to the normally present piston rod which is relatively large in cross section. Admittedly it might be possible to increase the axial length of the piston to make the accommodation space for the buffer body larger, and to set back the sealing lips in relation to the terminal piston faces so that the buffer body may be shifted farther outward in a radial direction. However then the overall length of the piston would be substantially increased, something which would hinder reducing the overall dimensions of a power cylinder.

SHORT SUMMARY OF THE INVENTION

One object of the invention is to provide a piston with an associated power cylinder such that despite effective damping at the end of stroke position compact dimensions are possible.

In order to achieve these and/or other objects appearing from the present specification, claims and drawings, the present invention provides a piston in the case of which at least at one terminal piston face the sealing lip itself constitutes the buffer body and is therefore provided at the end with the impact face, wherein several groove-like recesses, opening to the impact face, are formed on the inner periphery of the sealing lip with a distribution in the peripheral direction.

The sealing lip accordingly performs a double function because it both provides the sealing action with the piston running face and also functions as a buffer body for terminal position damping. The cross section of the piston can accordingly be reduced without having to sacrifice effective buffering on reaching the end of stroke position. In order to overcome the dilemma between on the one hand satisfactory yielding radially for optimum sealing and low friction and on the other hand satisfactory axial stiffness for an optimal buffering function, the sealing lip is provided on its inner periphery with several groove-like recesses distributed in the peripheral direction and opening toward the impact face. The sealing lip can accordingly be fashioned with a relatively large radial thickness to achieve a high axial stiffness, because owing to the locally distributed groove-like recesses the radial bias is reduced and a generally satisfactory radial potential deformation of the sealing lip is ensured.

The German patent publication 2,407,989 C2 discloses a power cylinder in the case of which in accordance with the drawings the sealing lips of the piston contact the terminal end caps in the end of stroke position. However the sealing lips are relatively thin in design so that they are not in position of absorbing a hard impact. The power cylinder is therefore additionally fitted with means for pneumatic damping in the end of stroke position.

Further advantageous developments of the invention are defined in the claims.

If terminal position damping in one stroke direction of the piston is desired, the buffer function may be restricted to one of the sealing lips. Preferably, however both sealing lips are in the form of buffer bodies with groove-like recesses provided on the inner periphery.

A linear course of the groove-like recesses in the axial direction appears to be the presently optimum configuration.

The depth and/or width of the groove-like recesses as measured radially on the sealing lip preferably changes in the length direction, more particularly so that the depth or, respectively, width is reduced from a maximum at the impact face toward the opposite end, preferably continuously.

If the piston has a coaxially extending piston rod, the groove-like recesses arranged on the inner periphery of the sealing lip surrounding the piston rod may also serve the purpose of ensuring unhindered action of pressure, even when the sealing lip is bent drastically radially inward, in a radially outward direction and accordingly apply the necessary surface pressure for a reliable sealing effect in relation to the piston running face.

The impact face provided terminally on the sealing lip, at which the piston in the end of stroke position may strike an impact face provided on the associated cylinder housing, is preferably provided with several wells distributed in the peripheral direction. The impact face is accordingly not a complete, uninterrupted annular face, but is composed of several spaced apart impact face sections, something offering the advantage that the pressure medium, for reversing the direction of the piston movement, may also act in the terminal portion of the sealing lip. The wells furthermore favor the action on the end of the piston in the end of stroke position, if the opening in the housing, by way of which the pressure medium is supplied, is placed radially to the outside in the piston running face.

An arrangement is regarded as advantageous, in which the groove-like recesses provided at the inner periphery of the sealing lip merge into one of the terminal wells. It is preferred for each groove-like recess to be provided in this manner with a terminal well.

The two sealing lips are preferably made integrally with one another. In one design as a so-called complete piston the piston as a whole may be an integral body having the sealing lips, such body being more particularly fashioned of elastomeric material and more especially polyurethane.

A satisfactory sliding action of the piston in the piston receiving space and also with low friction is produced if the piston does not have its full periphery engaging the piston running face, but only at individual guide ribs, which are distributed peripherally on the radially orientated outer periphery of the piston, more particularly in an integral manner.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES.

DETAILED ACCOUNT OF WORKING EMBODIMENT OF THE INVENTION

Figure 1:
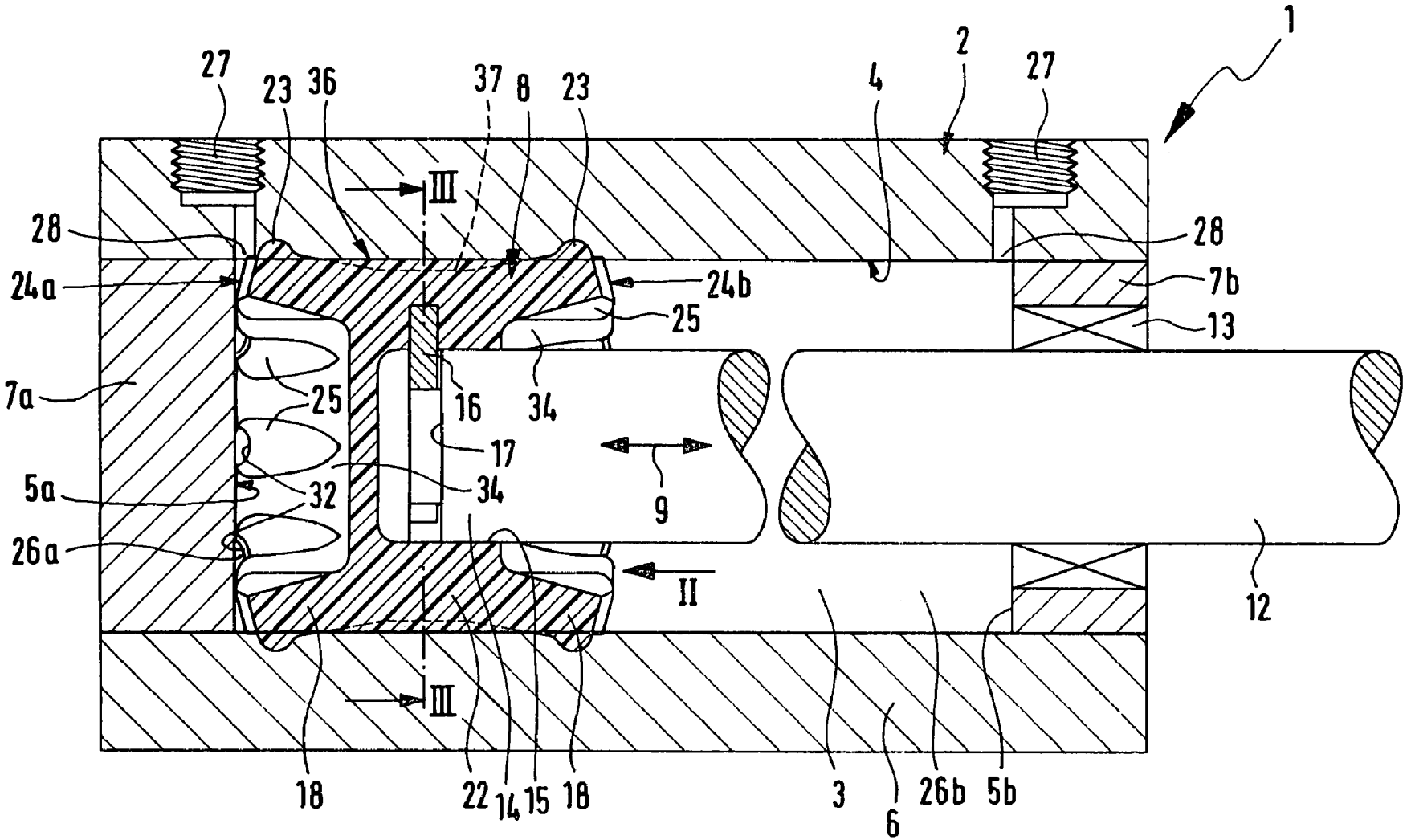
FIG. 1 shows a longitudinal section, partly diagrammatically, of a power cylinder having a piston in accordance with the invention with a preferred design, the longitudinal section of the piston corresponding to the section line I-I of FIG. 2.
Figure 2:
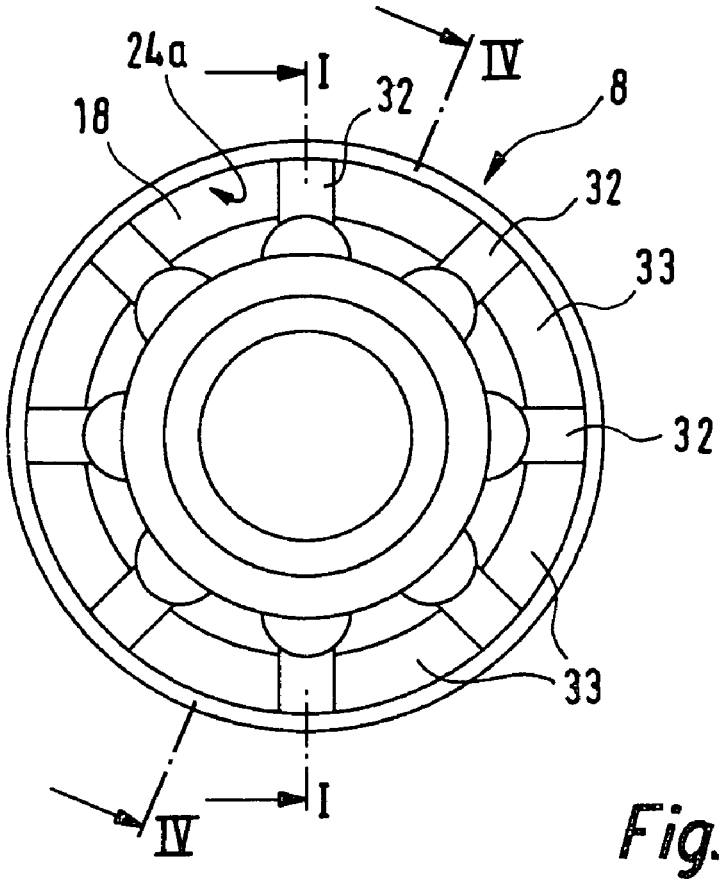
FIG. 2 is an end-on view of the piston as in FIG. 1 looking in the direction of the arrow II.
Figure 3:
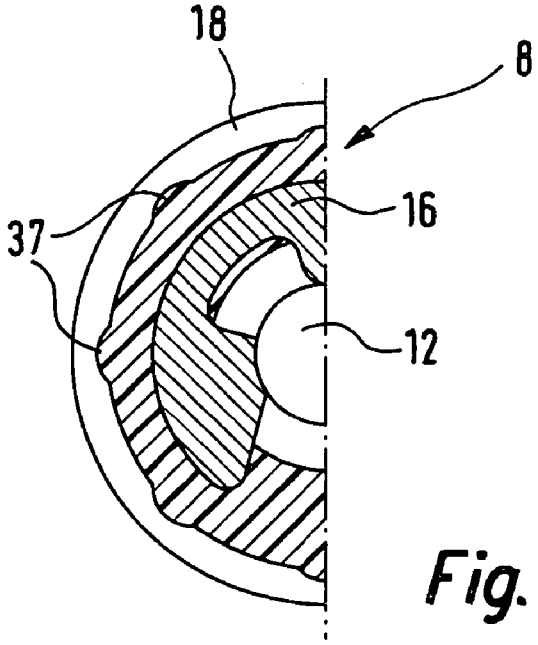
FIG. 3 is a partial cross section taken through the combination of the piston and piston rod on the section line III-III of FIG. 1.
Figure 4:
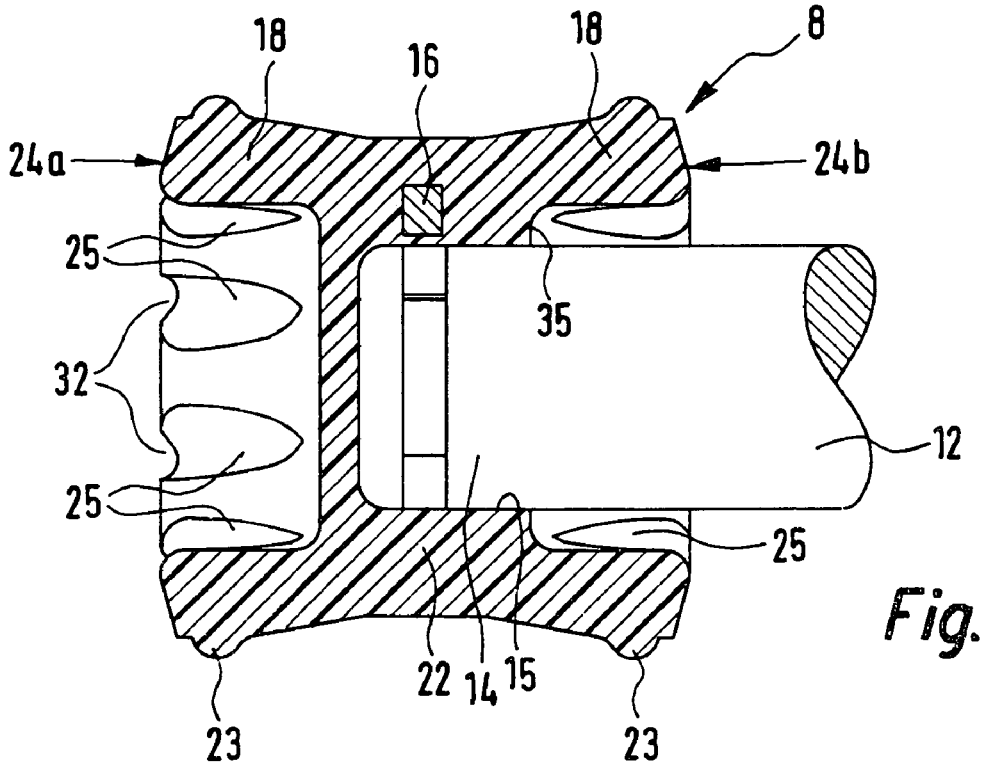
FIG. 4 shows a longitudinal section taken through the combination as in FIG. 1 of the piston and piston rod in a slightly rotated section plane on the section line IV-IV of FIG. 2.
Figure 5:
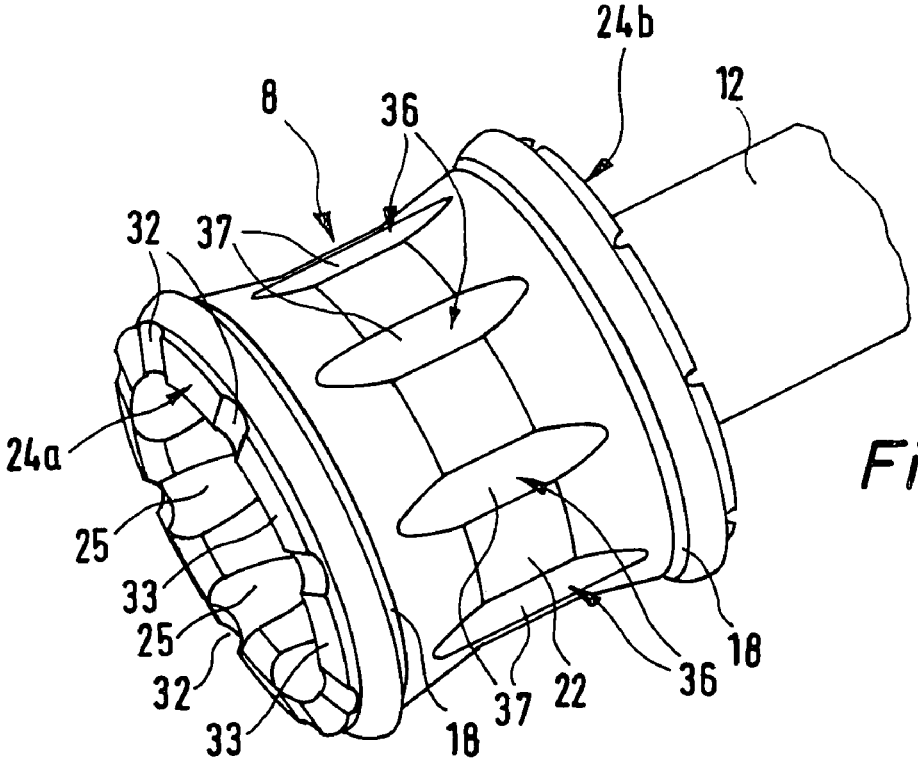
FIG. 5 shows a piston fitted with a piston rod in a separate perspective elevation.

The power cylinder 1 able to be actuated by fluid power in FIG. 1 is preferably designed for operation using compressed air, though it can be operated with a hydraulic fluid.

The power cylinder 1 comprises a cylinder housing 2, which defines an elongated and preferably cylindrically designed piston receiving space 3 which is peripherally delimited by a piston running face 4 on the housing and—at the two ends—a respective axially orientated abutment face 5*a* and 5*b*.

Preferably the cylinder housing 2 is composed of a cylinder barrel 6 defining the piston running face 4 and of two end caps 7*a* and 7*b* attached to the cylinder barrel 6 and defining respectively an abutment face 5*a* and 5*b*.

In the piston running face 3 a piston 8 linearly slides performing a stroke movement 9 indicated by a double arrow. On the piston 8 a piston rod 12 is attached which extends coaxially away from one of the two axially facing sides of the piston, such rod running in a sealing manner through the one end cap and protruding to the outside. The respective end cap 7*b* for this purpose has an opening through which the piston rod runs 12 and adjacent to it guide and sealing means 13, only indicated diagrammatically, are arranged on the housing for cooperation with the peripheral face of the piston rod 12.

The piston 8 is preferably an integral component manufactured of an elastomeric material such as polyurethane or the like, which possesses rubber-like elastic properties. The piston rod 12 can be plugged into it at a carrying section thereof. A design is regarded as particularly advantageous in which the piston 8 is produced by injection molding and molded directly on the piston rod 12. In this case the piston rod 12 has its terminal section, referred to in the following as the attachment end 14, plunges into a receiving recess 15, in the form of a blind hole produced during injection molding, in the piston 8.

In order to provide for a particularly intimate connection between the piston 8 and the piston rod 12, means may be provided which in addition to the adhesive effect, ensure an interlocking effective action in the direction of the stroke 9. For this purpose in the working example at the attachment end 14 of the piston rod 12 an anchoring part 16 radially protruding from the outer periphery is arranged, which is embedded in the material of the piston 8. In the particularly economic design of the working example the anchoring part 16 is constituted by a snap ring projecting radially and set in an anchoring groove 17 in the attachment end 14.

At its two axially facing sides the piston 8 has a respective annular sealing lip 18 adjacent to the outer periphery of the piston 8. These sealing lips 18 are coaxially arranged in relation to each other and are preferably connected integrally with each other, same extending from a central support section 22 of the piston 8, which also has the receiving recess 15, and extending away from one another axially in opposite directions.

The sealing lips 18 are so designed that at least in the case of the piston's not being inserted into the piston receiving space 3 the lips run radially obliquely outward at their end face opposite to the support section 22. It would be possible to talk of a conically widening form. On thrusting the piston into the piston receiving space 3 the sealing lips 18 are slightly bent radially inward by the surrounding piston running face 4, which has a smaller cross section, the resulting return force ensuring that the sealing lips 18 sealingly contact—at an annular sealing section 23 in the vicinity of the end face—the piston running face 4 with a bias force. The sealing sections 23 can be bead-like as seen in cross section.

In FIG. 1 the sealing lips 18 are shown in the non-deformed initial state for the sake of simplicity. In fact however they are bent inward and engage the piston running face 4.

The piston 8 is fitted with buffer bodies responsible for impact damping in the two terminal stroke positions, when the piston 8 during a stroke movement 9 strikes the abutment faces 5*a* and 5*b*. These buffer bodies are provided with the two sealing lips 18 in a single component so that the two sealing lips so that the two sealing lips 18 respectively directly constitute such a buffer body. The two sealing lips 18 in this case define respectively an impact face 24*a* and 24*b* at the axially facing sides facing the abutment face 5*a* and 5*b* on the housing, such impact face 24*a* and 24*b* contacting the opposite abutment face 5*a* and 5*b* in the end of stroke position.

Owing to the rubber-elastic properties of the sealing lips 18 there is a buffering effect on impact in the end of stroke position, which prevents damage and reduces noise during operation as well.

The sealing lips 18 are to be manufactured with a sufficient thickness in the radial direction in order to prevent their being deformed on impact against an abutment face 5*a* and 5*b* and possibly coming clear of the piston running face 4 to entail a loss of the sealing action. In order to ensure that the sealing lips 18 nevertheless possess a sufficient ability to radially deform to avoid an excessive bias toward the piston running face and accordingly increased friction, on the inner periphery of the sealing lip there are groove-like recesses 25 which are distributed in the sealing lip's peripheral direction and opening at the associated impact face 24*a* and 24*b*. They reduce the radial biasing force of the annular sealing lips 18 without interfering with the axial resistance to deformation of the sealing lips 18. The sealing lips 18 are in effect weakened owing to the groove-like recesses 25 at spaced apart positions distributed in the peripheral direction in order to favor the radial ability to deform.

In the working embodiment both sealing lips 18 are designed in the form of buffer pistons with groove-like recesses serving for weakening them at the inner periphery. If owing to the configuration of the power cylinder buffering or shock absorbing is only desired at one end of stroke position, the design of the sealing lip to take the form of a buffer body may be limited to one of the sealing lips.

Owing to the integration of the buffer function in the sealing lip 18 it is possible to dispense with a buffer body provided addition to the sealing lip, something which renders possible very small transverse dimensions of the piston 8.

As regards the measures necessary for the seal and buffer means a particularly critical feature is that side of the piston from which the piston rod 12 extends. The piston rod has, in the case of small cylinder sizes, a relatively large rod cross section in comparison with the cross section of the piston receiving space 3. Accordingly the radial dimensions of the annular space remaining between the piston rod 12 and the piston running face 4 are relatively small, something which will clearly appear from FIG. 1. Owing to the integration of the buffer function in the associated sealing lip 18 it is possible, even despite the small dimensions, for the necessary seal and also the desired buffering effect to be realized.

The groove-like recesses 25 provided on the sealing lip 18, which is on the piston rod side, furthermore improve the supply of compressed air from the piston receiving space 3 for the purpose of producing compressed-air-aided biasing of the sealing lip 18 against the piston running face 4. Furthermore this prevents the sealing lip 18 sticking to the outer face of the piston rod 12 in difficult conditions.

The piston 8 divides up the piston receiving space 3 with a sealing action into two working chambers 26*a* and 26*b*, which respectively communicate with a separate fluid duct 27, extending through the wall of the cylinder housing 2 and by way of which the pressure medium, necessary for operation, is supplied and removed.

In the working embodiment the two fluid ducts 27 are connected by way of orifices 28 with the associated working chamber 26*a* and 26*b*, such chambers being provided in the vicinity of the associated end cap 7*a* and 7*b* in the piston running face 4.

In order to ensure that the pressure medium, which is supplied with the piston 8 placed in the end of stroke position by way of the orifice 28 is able to act rapidly on the full area of the piston 8, the impact faces 24*a* and 24*b* are respectively divided up by wells 32 into a plurality of impact face sections 33, such wells 32 being formed terminally in the respective sealing lip 18 like the groove-like recesses 25. The impact face 24*a* and 24*b* striking an abutment face 5*a* and 5*b* in the end of stroke position is accordingly to be conceived of as an annular face which is multiply interrupted by the wells 32 so that in the end of stroke position there is no uninterrupted annular contact between the piston 8 and the abutment face 5*a* and 5*b*. The pressure medium arriving can therefore pass through the terminal wells 32 and flow to the central piston region.

As a particularly expedient feature the number of groove-like recesses 25 and terminal wells 32 for each sealing lip 18 are arranged in pairs so that one respective recess 25 merges into a respective terminal well 32.

The piston 8 is essentially skirted at its two terminal faces and here possesses a piston recess 34 surrounded radially to the outside by the associated sealing lip 18 but being open axially to the outside and inwardly is delimited by the support section 22. The receiving recess 15 coaxially adjoins the piston recess 34 on the piston rod at a cross section which is smaller than the recess 34.

The length of the groove-like recesses 25 which preferably extend linearly in the axial direction of the associated sealing lip 18 is preferably somewhat less than the axially measured depth of the respective associated piston recess 34. The groove-like recesses 25 are consequently preferably terminated just short of the axially orientated base face 35 of the associated piston recess 34.

Furthermore it is also an advantage for the radial depth of the groove-like recesses 34 to be reduced starting at a maximum at the associated base face 35, more particularly continuously. Moreover, the width, measured in the peripheral direction of the sealing lip 18, of the individual groove-like recesses 25 may be reduced correspondingly.

The piston 8 of the working embodiment is furthermore optimized in a particular manner as regards friction in as far as the guide face 36 arranged at the support section 22 at its outer periphery, and sliding on the piston running face, is not in the form of an uninterrupted annular face but is made up of individual islands or mutually spaced apart face sections, which are provided on guide ribs 37 distributed in the peripheral direction on the outer periphery of the piston 8. The guide ribs 27 extend in the axial direction and run more particularly between the root zones of the two sealing lips 18, i.e. the transitional area between the support section 22 and the respective sealing lip 18.

The guide ribs 27 are preferably formed integrally with the sealing lips 18. For this purpose they are preferably made an integral part of the preferably integral piston 8.

All in all it is a question of a piston in the case of which a sealing lip is integrated which is relatively long and simultaneously able to radially yield. It is in this manner that if necessary extremely small dimensions both of the piston and also of the power cylinder fitted with it, may be ensured.

The invention claimed is:

1. A piston for a power cylinder able to be operated by fluid force, comprising two coaxial and radially yielding sealing lips extending axially away from each other and adapted for sealing engagement with the piston engaging face of the power cylinder, and an elastic buffer body arranged in the vicinity of at least one terminal piston face and adapted to serve for impact damping in the end of stroke position of the piston, said buffer body having an impact face turned away from the piston, wherein the sealing lip itself constitutes the buffer body and is provided at the end with the impact face, and wherein several groove-like recesses, opening to the impact face, are formed on the inner periphery of the sealing lip with a distribution in the peripheral direction, said recesses having a depth less than the thickness of the sealing lip whereby the recesses do not extend through the sealing lip to the outer periphery of the sealing lip.

2. The piston as set forth in claim 1, wherein the two sealing lips are designed in the form of buffer bodies having groove-like recesses provided on the inner periphery.

3. The piston as set forth in claim 1, wherein the groove-like recesses extend linearly in the axial direction of the sealing lip.

4. The piston as set forth in claim 1, comprising a piston rod extending coaxially away from at least one piston end side, such rod being surrounded by the sealing lip associated with the respective piston end side leaving an annular radial intermediate space.

5. A power cylinder comprising a cylinder barrel delimiting a piston receiving space having a peripheral piston running face and terminal abutment faces and in which an axially sliding piston as set forth in claim 1 is arranged.

6. The power cylinder as set forth in claim 5, further comprising a piston rod attached to the piston.

7. The piston as set forth in claim 1, wherein at a respective sealing lip the piston is skirt-like in form with a piston recess surrounded by the sealing lip.

8. The piston as set forth in claim 1, wherein the groove-like recesses terminate short of an axially orientated base face of the piston recess surrounded by the respective sealing lip.

9. The piston as set forth in claim 1, wherein the two sealing lips are integral with each other in design.

10. The piston as set forth in claim 1, wherein said piston is in the form of an integral body having the sealing lips.

11. The piston as set forth in claim 10, having a central blind hole as a receiving well to accommodate the terminal section of a piston rod secured to the piston.

12. A piston as set forth in claim 1, wherein the entire piston is formed of elastomeric material.

13. The piston as set forth in claim 12, wherein the entire piston is formed of polyurethane.

14. A piston as set forth in claim 1, further comprising axially extending guide ribs arranged with a distribution in the peripheral direction, such ribs being present on and protruding radially outwardly from the radially orientated outer periphery of the piston.

15. The piston as set forth in claim 14, wherein said guide ribs are formed integrally with the sealing lips.

16. The piston as set forth in claim 14, wherein the ribs extend longitudinally between root regions of the sealing lips.

17. A piston for a power cylinder able to be operated by fluid force, comprising two coaxial and radially yielding sealing lips extending axially away from each other and adapted for sealing engagement with the piston engaging face of the power cylinder, and an elastic buffer body arranged in the vicinity of at least one terminal piston face and adapted to serve for impact damping in the end of stroke position of the piston, said buffer body having an impact face turned away from the piston, wherein at least at one terminal piston face the sealing lip itself constitutes the buffer body and is provided at the end with the impact face, and wherein several groove-like recesses, opening to the impact face, are formed on the inner periphery of the sealing lip with a distribution in the peripheral direction, wherein the depth and/or width of the groove-like recesses is more particularly continuously reduced, starting at a maximum at the impact face, toward the opposite end.

18. A piston as set forth in claim 17, wherein the entire piston is formed of elastomeric material.

19. A piston as set forth in claim 17, further comprising axially extending guide ribs arranged with a distribution in the peripheral direction, such ribs being present on and protruding radially outwardly from the radially orientated outer periphery of the piston.

20. A piston for a power cylinder able to be operated by fluid force, comprising two coaxial and radially yielding sealing lips extending axially away from each other and adapted for sealing engagement with the piston engaging face of the power cylinder, and an elastic buffer body arranged in the vicinity of at least one terminal piston face and adapted to serve for impact damping in the end of stroke position of the piston, said buffer body having an impact face turned away from the piston, wherein at least at one terminal piston face the sealing lip itself constitutes the buffer body and is provided at the end with the impact face, and wherein several groove-like recesses, opening to the impact face, are formed on the inner periphery of the sealing lip with a distribution in the peripheral direction, wherein the impact face is divided up into a plurality of impact face sections by wells which are formed terminally in the sealing lip and are distributed in the peripheral direction.

21. The piston as set forth in claim 20, wherein the groove-like recesses provided on the inner periphery of the sealing lip at least partially merge respectively with one of the terminal wells.

22. A piston as set forth in claim 20, wherein the entire piston is formed of elastomeric material.

23. A piston as set forth in claim 20, further comprising axially extending guide ribs arranged with a distribution in the peripheral direction, such ribs being present on and protruding radially outwardly from the radially orientated outer periphery of the piston.

* * * * *